US005792082A

United States Patent [19]

Yamanaka et al.

[11] Patent Number: 5,792,082

[45] Date of Patent: Aug. 11, 1998

[54] CHAIR-TYPE AIR MASSAGE DEVICE

[75] Inventors: Nobuyuki Yamanaka; Masaki Wada, both of Osaka, Japan

[73] Assignee: Kabushiki Kaisha Fuji Iryoki, Osaka, Japan

[21] Appl. No.: 662,703

[22] Filed: Jun. 13, 1996

[51] Int. Cl.[6] ..... A61H 7/00; A61H 19/00

[52] U.S. Cl. ..... 601/148; 601/49; 601/149; 601/55

[58] Field of Search ..... 601/149, 148, 601/155, 49, 57, 5, 55; 128/781; 606/237, 238, 239, 240

[56] References Cited

U.S. PATENT DOCUMENTS

| | | | |
|---|---|---|---|
| 2,684,672 | 7/1954 | Summerville | 128/33 |
| 3,092,100 | 6/1963 | Oetinger | 601/57 |
| 3,483,862 | 12/1969 | Takeuchi | 128/33 |
| 3,536,063 | 10/1970 | Werding | 128/24 |
| 3,595,223 | 7/1971 | Castagna | 601/148 |
| 3,613,671 | 10/1971 | Poor | 601/149 |
| 3,654,919 | 4/1972 | Birtwell | 128/64 |
| 3,760,801 | 9/1973 | Borgeas | 128/25 |
| 3,783,859 | 1/1974 | Sauer et al. | 128/24 |
| 3,924,613 | 12/1975 | Beck | 128/24 |
| 4,258,706 | 3/1981 | Shank | 601/55 |
| 4,981,131 | 1/1991 | Hazard | 128/38 |
| 5,022,385 | 6/1991 | Harza | 601/149 |
| 5,135,282 | 8/1992 | Pappers | 297/284 |
| 5,314,403 | 5/1994 | Shaw | 601/148 |
| 5,437,608 | 8/1995 | Cutler | 601/57 |
| 5,462,516 | 10/1995 | Anderson | 601/99 |

FOREIGN PATENT DOCUMENTS

| | | | |
|---|---|---|---|
| 0270699A1 | 6/1988 | European Pat. Off. . | |
| 2-45902 | 10/1990 | Japan . | |
| 4-327849A | 11/1992 | Japan . | |
| 405285182 | 11/1993 | Japan | 601/49 |
| 1477407 | 5/1989 | U.S.S.R. | 601/49 |

*Primary Examiner*—Kien T. Nguyen
*Assistant Examiner*—Justine R. Yu
*Attorney, Agent, or Firm*—Flynn, Thiel, Boutell & Tanis, P.C.

[57] ABSTRACT

A chair-type air massage device which is capable of providing air massage to a user's whole body in a reclined position. The air massage device includes a backrest pivotally joined with a seat. Armrests are secured to both sides of the seat. A footrest is joined to the front end of the seat and can be moved between a projected position and a retracted position. Air bags for a neck massage, air bags for a back massage and air bags for a waist massage are disposed on the backrest. Further, air bags for a buttocks massage are disposed on the seat. Air bags for a thigh massage are positioned between armrests on the seat. Air massage can be provided to a user's whole body in a reclined position by supplying and exhausting compressed air to each of the air bags to thereby expand and contract each of the air bags.

14 Claims, 4 Drawing Sheets

CHAIR-TYPE AIR MASSAGE DEVICE

CROSS-REFERENCE TO RELATED APPLICATIONS

Cross reference is made to our co-pending U.S. patent application Ser. No. 08/662,698, entitled "CHAIR-TYPE AIR MASSAGE DEVICE" which is assigned to the same assignee as the present invention, and filed concurrently herewith.

BACKGROUND OF THE INVENTION

1. Field of the Invention

This invention relates to a chair-type massage device, especially a chair-type air massage device which has inflatable and deflatable air bags for massaging a user's body part by air pressure causing an expansion and contraction of the air bags.

2. Description of the Prior Art

Previously, various kinds of chair-type massaging devices, for example, a chair-type kneading massage device equipped with a kneading function, a chair-type knocking massage device equipped with a knocking function, a chair-type rolling massage device equipped with a rolling function, and a chair-type finger pressure massage device equipped with a finger pressure function have been developed and manufactured and each of them has its own characteristic function so that users can select one according to their preference to use.

However, females and older people tend to avoid using them because the conventional chair-type massage devices provide strong friction against a user's skin. Therefore, in recent years, the development of a chair-type massage device which gives not only rather weak friction but also a massage effect has been desired.

In compliance with this requirement, a chair-type air massage device which has air bags in a body of a chair in order to massage a user's local body part by using air pressure to expand and contract air bags has been recently developed.

This chair-type air massage device, such as disclosed in Japanese Patent Publication No. 45902 (1990), is equipped with several air bags installed in the backrest. The neck, back and waist of a human body can be massaged by sequentially supplying and exhausting compressed air to several air bags to expand and contract them.

In the above-mentioned chair-type air massage device, it is convenient that the friction against a user's skin is weaker than conventional chair-type massage devices and the appropriate massaging effect can be provided because it is designed to massage a user's neck, back or waist by expanding and contracting the air bags. However, the user's back is pushed forward and the user's whole body is moved forward when the air bags are expanded since this chair-type air massage device is designed to massage a user's back by expanding and contracting the air bags in the backrest which is always fixed at a certain angle.

As a result, a user can not get a comfortable massage effect since a user must step forward and stretch both legs on a floor and bend himself backward to fit himself to the air bags in order to get a more appropriate massage effect.

SUMMARY OF THE INVENTION

An object of the present invention is to provide a chair-type air massage device which is capable of massaging a user's back and waist in a comfortable position.

Another object of the present invention is to provide a chair-type air massage device which is capable of massaging a user's buttocks.

A further object of the present invention is to provide a chair-type air massage device which is capable of massaging a user's thigh.

A chair-type air massage device of the present invention is equipped with a backrest joined to a rear end of a seat and which can be inclined relative to the seat, air bags for a back massage and a waist massage disposed in the backrest, and an intake/exhaust control mechanism which supplies and exhausts compressed air to the air bags.

The present invention also includes a footrest joined to a front end of the seat which is movable between a forwardly-projected position and a retracted position extending below the front end of the seat. The present invention includes air bags disposed on the seat for providing a buttocks massage.

The present invention also includes air bags disposed on an upper portion of the backrest for providing a neck massage. The air bags for providing a neck massage are movable between an upper position and a lower position relative to the backrest. The present invention also includes air bags disposed on the seat for providing a thigh massage.

A chair-type air massage device of the present invention provides an air massage to a user's back and waist in a comfortable reclined position by inclining the backrest rearward to a desirable angle. The user may then position himself on the chair-type air massage device so as to position the user's back and waist over the respective air bags. The chair-type air massage device supplies and exhausts compressed air to the air bags to expand and contract them.

Thus, a user can lie down and put his weight against the expansive pressure of air bags in a comfortable position so that the use can obtain a massage comfortably without straining muscles such as stretching the user's legs on a floor and bending himself backward. By moving the footrest to a projected position and placing the user's legs on the footrest, the user can stretch his legs at a level while lying on his back in order to get massage in more comfortable position.

If air bags for providing a buttocks massage, neck massage or thigh massage are installed, air massage for the user's respective body parts can be provided in a comfortable reclined position. In addition, the user's neck can be fully massaged by adjusting the position of the air bags for a neck massage.

Other objects and purposes of the invention will be apparent to persons familiar with devices of this general type upon reading the following specification and inspecting the accompanying drawings.

PREFERRED EMBODIMENT OF THE INVENTION

Figure 1:
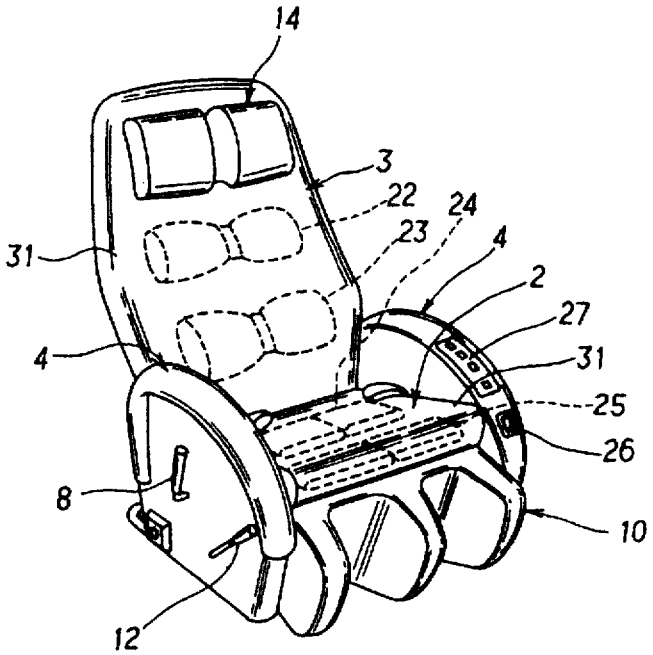
FIG. 1 is a perspective view showing an embodiment of the chair-type air massage device of the present invention.
Figure 2:
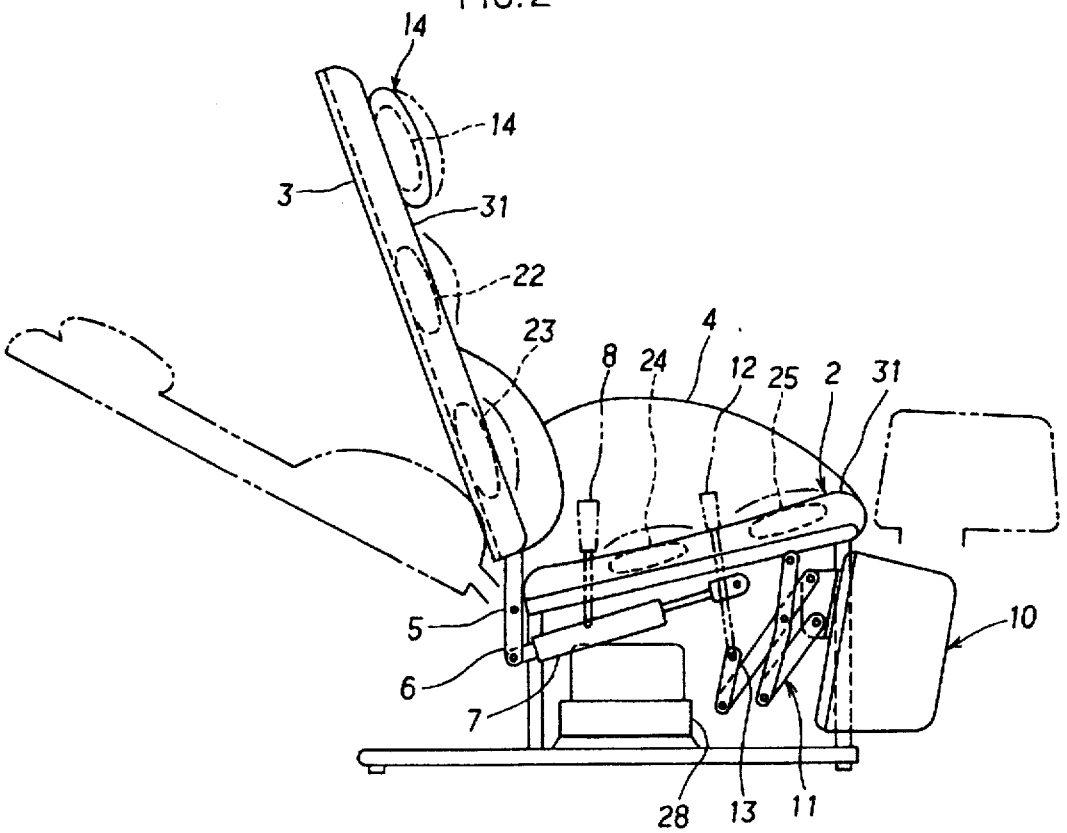
FIG. 2 is a sectional view of the chair-type air massage device of the present invention.

FIG. 1 shows a perspective view and FIG. 2 shows a center longitudinal sectional view of an embodiment of the air massage chair of the present invention. The air massage chair comprises a seat 2, backrest 3 secured to the seat 2 and having an adjustable inclination relative to the seat 2, and armrests 4 disposed on right and left sides of the seat 2.

Figure 3:
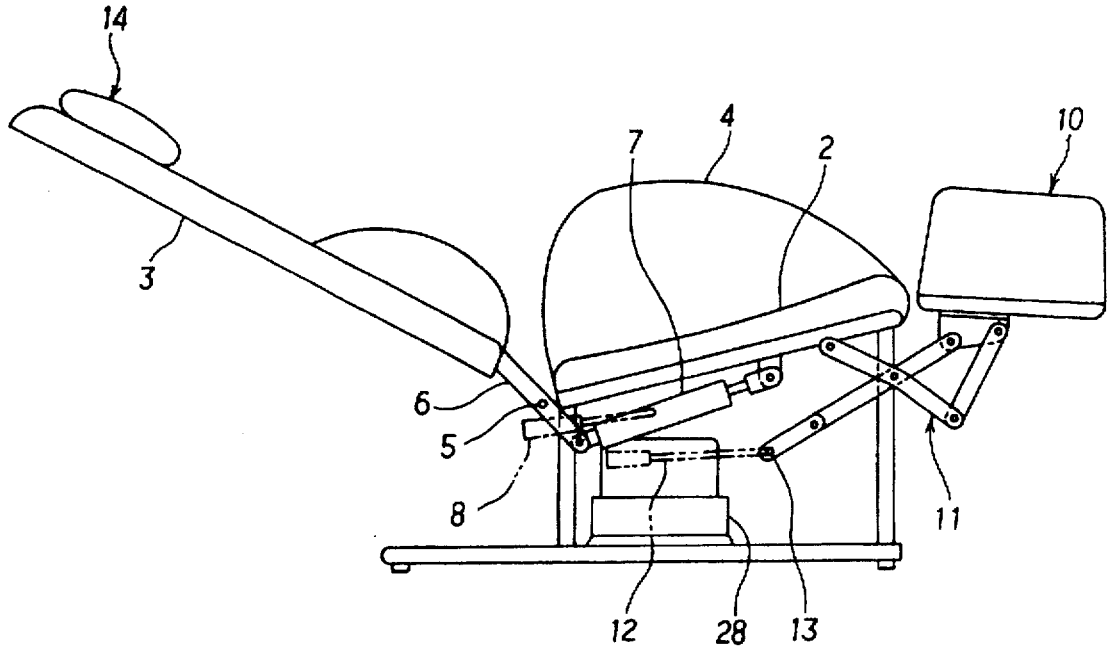
FIG. 3 is a side elevational view of the chair-type air massage device of the present invention.

A mechanism for securing the backrest 3 to the seat 2, for example, as FIG. 2 and FIG. 3 show, includes a frame 6 extending downward below the backrest 3 and secured to the back side of the seat 2 around a rotatable shaft 5 for permitting forward and rearward rocking movement, and a fluid pressure (i.e. hydraulic) cylinder 7 rotatably supported and connected to the lower end of the frame 6 below the rotatable shaft 5. Therefore, the pressure cylinder 7 is operated by a reclining lever 8 disposed on the outer side of the seat 2, such that the backrest 3 can be optionally inclined around the rotatable shaft 5.

A footrest 10 is secured to the front end of the seat 2, and the footrest 10 is capable of changing positions between a projected position wherein it is projected forward of the seat 2 in a nearly horizontal level orientation wherein it is nearly aligned with the front edge of the seat as shown in FIG. 3, and a retracted position wherein it is retracted below the front end of the seat 2 in a nearly vertical orientation as shown in FIG. 2. For example, the footrest 10 is secured to the seat 2 by linkage 11, and can be changed between the projected position or the retracted position through the linkage 11 by turning a turn shaft 13 around a center thereof by a manual lever 12 which is fixed to the shaft but is disposed on the outer side of the seat 2.

Figure 5:
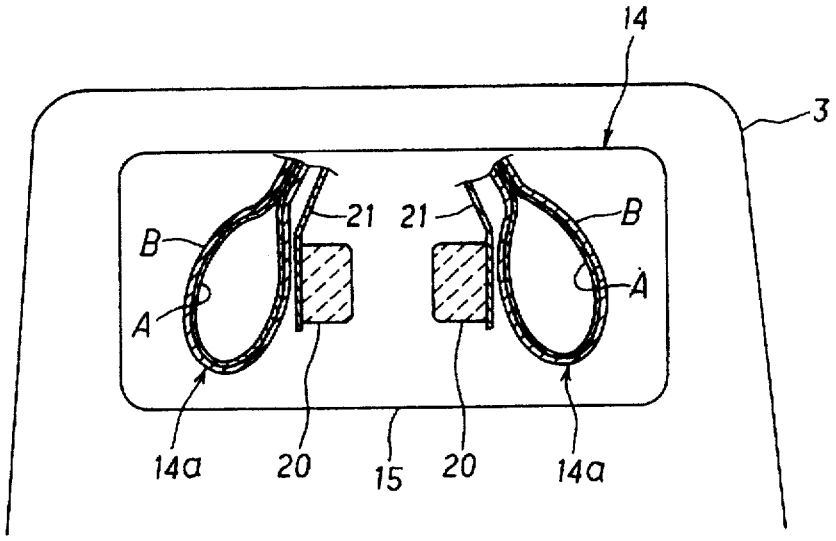
FIG. 5 is a partial cross-section view showing an air bag arrangement for massaging a user's neck in the chair-type air massage device of the present invention.
Figure 6:
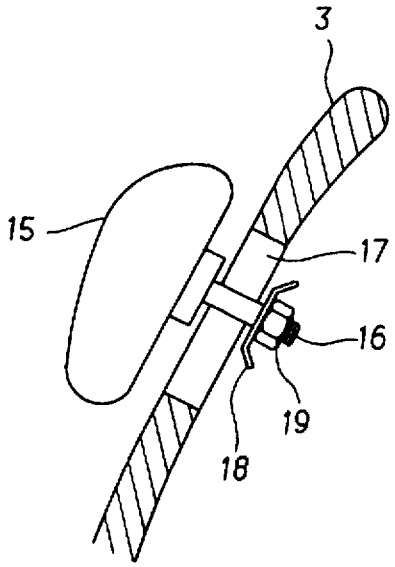
FIG. 6 is a partial cross-section view showing a mechanism for adjusting the position of the air bags for a neck massage relative to a seatback of the chair-type air massage device of the present invention.

Air bags 14 defining a neck massage pillow for permitting a neck massage are secured to the upper part of the backrest 3, and as shown in FIG. 5 and FIG. 6, the right and left air bags 14*a*, 14*a* are placed in a row and covered with a pillowcase or cover 15. A bolt 16 projects from the rear thereof. The air bags 14 are adjustable in an up and down direction relative to the upper part of the backrest 3 by inserting the bolt 16 from the front side of the backrest 3 through a longitudinal slit 17 provided in the upper part of the backrest 3, and securing a nut 19 to the rear end of the bolt 16 with a washer 18 positioned under the nut. Therefore, the air bags 14 are positioned by loosening the nut 19 and sliding the air bags 14 to the required position guided by the slit 17 and resecuring the nut 19.

Each air bag 14*a*, 14*a* has a finger pressure member or ball 20 made of hard urethane foam etc. together with a flexible plate 21 such as a resin plate so that the finger pressure balls 20 can provide a pressurization and de-pressurization function efficiently to both sides of a user's neck due to the expansion of the air bags 14*a* causing the members 20 to move in generally opposed relation for engaging both of the neck. As shown in FIG. 5, the air bags 14*a*, 14*a* are composed of internal and external layers A, B. Polyurethane, which is effective for air leakage prevention, may be used for the internal layer A, and 6-nylon, which is effective for excessive expansion prevention, may be used for the external layer B.

Figure 4:
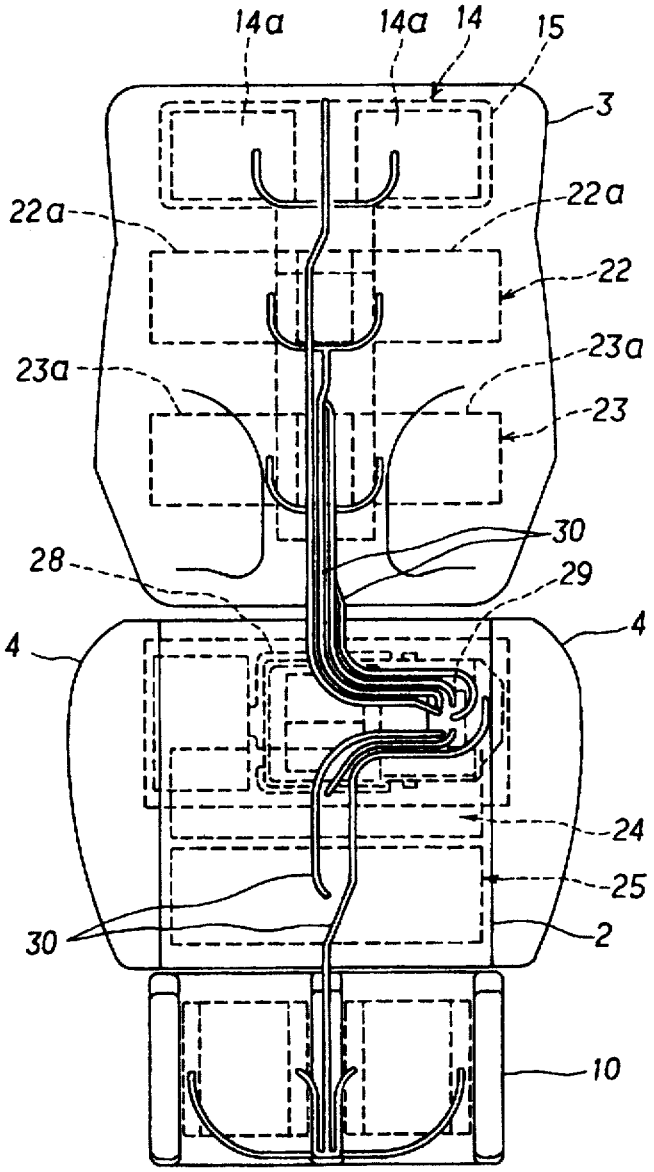
FIG. 4 is a plan view showing an air bag arrangement for massaging a user's various body parts in the air massage device of the present invention.

As shown in FIG. 1 and FIG. 4, air bags 22 for a back massage and air bags 23 for a waist massage are disposed below the air bags 14 on the backrest 3. Each of the air bags 22, 23 is formed by separate left air bags 22*a*, 23*a* and right air bags 22*a*, 23*a* so that they provide and relieve the pressure against the muscle on both sides of a user's spine. Each of the air bags 22, 23 are covered with an exterior cover 31 made of flexible and smooth materials such as chloroethylene leather or cloth etc. which covers the whole backrest 3, and loosely covers each of the air bags 22, 23 so that it expands according to the expansion of each air bag 22, 23.

Air bags 24 for a buttocks massage provide and relieve the pressure against a user's right and left buttocks, and are disposed on the seat 2. Air bags 25 for a thigh massage are installed on the seat 2 in front of the air bags 24. Each of the air bags is comprised of internal and external layers similar to the air bags 14 as shown in FIG. 5. Each air bag is also covered with an exterior cover made of the same materials as the exterior cover 31 which covers the whole upper surface of the seat 2. The exterior cover loosely covers the air bags so that it expands according to the expansion of the air bags 24, 25.

An intake/exhaust control mechanism which supplies and exhausts compressed air to each of the air bags is disposed in the lower part of the seat 2. As shown in FIG. 1, the intake/exhaust control mechanism has an ON-OFF power switch 26 and several massage selecting switches 27 on the armrest 4. As shown in FIG. 4, an air source 28 such as an air compressor or air pump, a distributor 29 having valves (not shown) which distributes compressed air to each air bag from the air source 28 in the lower part of the seat 2, and intake/exhaust ports of each air bag are interconnected by hoses 30.

The massage selecting switches 27 include a general massage button which provides a general massage for a user's neck, back, waist, buttocks, and thighs sequentially, and several separate massage buttons which selectively provide independent partial massages. Turning on the power switch 26 and pushing the general massage button of the selecting switches 27, for example, sequentially causes each of the air bags 14 for a neck massage, air bags 22 for a back massage, air bags 23 for a waist massage, air bags 24 for a buttocks massage and air bags 25 for a thigh massage to repeatedly expand and contract to sequentially provide an air massage to a user's neck, shoulders, back, waist, buttocks and thigh in that order, by varying the air pressure supplied to the air bags. Further, by pushing a button for any of the air bags separately, compressed air can be supplied and exhausted to only specific air bags through the distributor 29 so as to provide an intensive air massage to a user's neck, for example.

In the above embodiment, each of the air bags 14 for a neck massage, back massage 22, waist massage 23, buttocks massage 24 and thigh massage 25 is installed at an appropriate position for providing an air massage to almost a user's whole body, but any or some of the air bags 14 for neck massage, air bags 24 for a buttocks massage, and air bags 25 for a thigh massage may be omitted.

Instead of using the linkage 11 and the manual lever 12 as a means for varying the position of the footrest 10 relative to the seat 2, the footrest 10 may be connected to the seat 2 via a rotatable shaft which changes the position of the footrest 10 by rotating the footrest 10 around the shaft by operating a pressure cylinder.

The present invention can provide air massage to a user's back and waist while comfortably lying on his back by optionally inclining the backrest rearwardly and lying on his back on the backrest and fitting his back and waist to the air bags for back and waist massage and supplying and exhausting compressed air to the air bags to expand and contract the air bags.

Further, the present invention has the footrest 10 which can be varied between the projected position and the retracted position on the front end of the seat so that air massage can be provided to a user's legs by putting his legs on the footrest in the projected position and comfortably lying on his back. When the footrest 10 is in the retracted position, air massage can be provided without being disturbed by the footrest in the sitting position.

Further, the present invention can provide air massage to a user's buttocks while comfortably lying on his back since the air bags 24 for a buttocks massage are installed on the seat and it can be provided together with air massage to a user's back and waist.

Still further, the present invention can provide air massage to a user's neck while lying on his back or sitting comfortably since the air bags 14 for a neck massage are secured to the upper part of the backrest 3 and can be provided together with air massage to a user's back and waist.

Still further, the present invention has the air bags 14 for a neck massage which are movably installed for upward and downward movement so that air massage can be efficiently provided to a user's neck by expanding and contracting the air bags sequentially after positioning them up or down relative to the user's neck.

The present invention is convenient because the air bags 25 for thigh massage are installed on the seat 2 so that air massage can be provided to a user's thigh while lying on his back or sitting comfortably together with an air massage for a user's back and waist.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A chair-type air massage device comprising:

a seat adapted to support a person thereon;

a first plurality of air bags disposed in the seat for massaging buttocks of a person seated on the seat;

an elongate backrest pivotally joined with a first end of the seat, the backrest having a front side adapted to receive a back of a person thereon and being reclinable so that a person resting on the front side thereof in a reclined position rests on top of the backrest;

a second plurality of air bags disposed on the backrest for massaging a back of a person resting on the front side of the backrest, the second plurality of air bags being disposed in a central portion of the backrest;

a third plurality of air bags disposed on the backrest for massaging a waist of a person resting on the backrest, the third plurality of air bags being disposed in a lower portion of the backrest closer to the seat than the second plurality of air bags;

means for massaging a neck of a person positioned on the front side of the backrest, the neck massaging means extending outwardly from the front side and being positioned adjacent an upper free edge of the backrest and upwardly from the second plurality of air bags, the neck massaging means including a fourth plurality of air bags adapted to expand and contract, pressure applying members movable in response to the fourth plurality of air bags for massaging opposite sides of the neck, and means for linearly adjusting position of the neck massaging means in an elongate direction along the front side of the backrest transverse to the upper free edge so as to adjust the neck massaging means to the specific person resting on the backrest; and an intake/exhaust control assembly which supplies and exhausts compressed air from an air source through a distributor to and from the first, second, third and fourth plurality of air bags.

2. The air massage device according to claim 1, further including a footrest cantileveredly pivotally joined with a second end of the seat remote from the first end, the footrest being movable between an extended position outwardly from the seat and a retracted position generally beneath the second end of the seat extending generally transverse thereto, and the footrest having a fifth plurality of air bags adapted to expand and contract for massaging the legs of a person.

3. The air massage device according to claim 1, wherein the neck massaging means and the fourth air bags are moveable along the front side of the backrest between an upper position to provide neck massages for taller people and a lower position closer to the second plurality of air bags to provide neck massages for generally shorter people.

4. The air massage device according to claim 1, further including a fifth plurality of air bags disposed on the seat for massaging a thigh of a person seated on the seat.

5. The air massage device according to claim 1 wherein the distributor is responsive to a switch for directing compressed air to either the first plurality of air bags or the second plurality of air bags.

6. The air massage device according to claim 1 wherein the distributor is responsive to a switch for sequentially directing compressed air to the first plurality of air bags and then to the second plurality of air bags.

7. The air massage device according to claim 1, wherein the neck massaging means is positioned below the upper free end of the backrest.

8. The air massage device according to claim 1, wherein the means for linearly adjusting the neck massaging means includes a longitudinally extending slot in the backrest and a securement member extending through the slot for selectively securing the neck massaging means along the slot so as to position the neck massaging means at the select height along the backrest for the individual receiving a massage.

9. The air massage device according to claim 8, wherein the securement member has a fastener body extending through the slot and a fastener member engaging the fastener body and backrest to selectively fix the neck massaging means on the backrest, the fastener body and slot only allowing linear movement of the neck massaging means relative to the backrest so as to correctly position the neck massaging means for individuals of varying height.

10. The air massage device according to claim 1, wherein the first, second, third and fourth pluralities of air bags each comprise two laterally spaced side-by-side air bags, each air bag separately receiving compressed air from the intake/exhaust control assembly.

11. A massage device, comprising:

a seat having front and rear edges and an upward facing support surface for supporting a person thereon in a seated position;

a first plurality of air bags adapted to expand and contract for massaging the buttocks and thighs, the first plurality of air bags being positioned on the support surface beneath a person seated thereon so that the weight of the person is against an expanding one of the first plurality of air bags;

an elongate backrest cantilevered from the rear edge of the seat adapted to support a back of a person in the seated position, the backrest including a back-engaging surface and a pivot means for positioning the backrest relative to the seat in a reclined position, the pivot means reclining the backrest from a generally vertical orientation to a generally horizontal orientation substantially parallel to the support surface of the seat;

a second plurality of air bags adapted to expand and contract for massaging the back and waist of a person, the second plurality of air bags being positioned in the backrest adjacent the back and waist of a person in the seated position and so that the weight of the person is against an expanding one of the second plurality of air bags when the backrest is in the reclined position;

a neck massage pillow movably connected to the backrest adjacent an upper free edge of the backrest, the neck massage pillow extending forwardly from the back-engaging surface of the backrest;

means for linearly positioning the neck massage pillow along the longitudinal extent of back-engaging surface of the backrest so that the neck massage pillow is positioned at the neck of the person in the seated position;

a third plurality of air bags adapted to expand and contract, pressure applying members are movable in response to the third plurality of air bags for massaging the neck of a person, the third plurality of air bags being positioned in the neck message pillow and adjacent the neck of a person when the neck massage pillow is correctly positioned on the backrest for the person in the seated position; and a control means for supplying and exhausting air to each of the first, second and third plurality of air bags to effect the desired massaging operation.

12. The massage device according to claim 11, wherein flexible plates are joined to the neck massage pillow adjacent the third plurality of air bags, the pressure applying members are mounted to the flexible plates, the flexible plates being respectively movable in response to the expansion and contraction of the third plurality of air bags so that the pressure applying members effect a massage of opposite sides of a person's neck.

13. The massage device according to claim 12, wherein the means for positioning the neck massage pillow includes an elongate slot in the backrest, a securement body extending from the neck massage pillow through the slot, and a securement member engaging the securement body for securing the securement body along the slot.

14. In a massage device having a chair configuration for massaging a person seated thereon, the massaging device having a seat and a backrest extending upwardly from the seat, a plurality of air bags are provided in the seat and backrest for massaging the person in response to receipt of air from an air source, and a neck massaging device is mounted on the backrest, wherein:

the neck massaging device extends outwardly from a supporting surface of the backrest, the supporting surface being adapted to receive a back of a person thereon;

the neck massaging device has two sidewardly spaced air bags adapted to expand and contract, two sidewardly spaced flexible members being respectively mounted closely adjacent the two air bags, and two massaging members being respectively positioned on the two flexible members for massaging opposite sides of a person's neck positioned therebetween in response to the expansion and contraction of the two air bags; and means for selectively securing the neck massaging device along the height of the backrest for linearly positioning the neck massaging device at the neck of a person seated on the massage device, the neck massaging device being positioned below the upper edge of the backrest.

* * * * *

UNITED STATES PATENT AND TRADEMARK OFFICE

CERTIFICATE OF CORRECTION

PATENT NO. : 5 792 082

DATED : August 11, 1998

INVENTOR(S) : Nobuyuki Yamanaka et al

It is certified that error appears in the above-indentified patent and that said Letters Patent is hereby corrected as shown below:

On the title page, please insert the priority information as follows:

---[30] Foreign Application Priority Data

June 14, 1995 [JP] Japan.....7-171546---.

Signed and Sealed this

Twenty-second Day of August, 2000

*Attest:*

*Attesting Officer*

Q. TODD DICKINSON

*Director of Patents and Trademarks*